US005389026A

United States Patent [19]

Fukuta et al.

[11] Patent Number: 5,389,026

[45] Date of Patent: Feb. 14, 1995

[54] METHOD OF PRODUCING METALLIC MICROSCALE COLD CATHODES

[75] Inventors: Shinya Fukuta; Keiichi Betsui, both of Kawasaki, Japan

[73] Assignee: Fujitsu Limited, Kawasaki, Japan

[21] Appl. No.: 82,170

[22] Filed: Jun. 28, 1993

Related U.S. Application Data

[63] Continuation of Ser. No. 867,514, Apr. 13, 1992, abandoned.

[30] Foreign Application Priority Data

Apr. 12, 1991 [JP] Japan ..... 3-079464

[51] Int. Cl.[6] ..... H01J 9/02; H01J 1/30

[52] U.S. Cl. ..... 445/24; 445/50; 204/221

[58] Field of Search ..... 445/24, 50, 51; 205/221, 229

[56] References Cited

U.S. PATENT DOCUMENTS

| | | | |
|---|---|---|---|
| 3,833,435 | 9/1974 | Logan et al. | 205/221 |
| 3,921,022 | 11/1975 | Levine | 445/50 |
| 4,244,792 | 1/1981 | Baldwin | 205/229 |

FOREIGN PATENT DOCUMENTS

| | | | |
|---|---|---|---|
| 52-9371 | 1/1977 | Japan | 445/24 |
| 62-105459 | 5/1987 | Japan . | |
| 2-257635 | 10/1990 | Japan . | |
| 2-288128 | 11/1990 | Japan | 445/51 |
| 3-223719 | 10/1991 | Japan . | |

OTHER PUBLICATIONS

J. Micromech. Microeng. 2 (1992) 43–74, Review "Vaccum Microelectronics–1992", Heinz H. Busta, pp. 43–74.

Technical Digest of IVMC 91, Nagahama 1991, "Fabrication and Characteristics of Si Field Emitter Arrays", Keiichi Betsu, pp. 26–29.

"Fabrication and Operation of Silicon Micro–Field–-Emitter–Array", K. Betsui, Autumn National Conventional Record, IEIOCE, 5, pp.2 82–283 (1990), (Complete Japanese Version and Partial Translation).

Mat. Res. Soc. Symp. Proc., vol. 76, 1987 Materials Research Society, "A Silicon Field Emitter Array Planar Vacuum FET Fabricated with Microfabrication Techniques", Henry F. Gray and G. J. Campisi, pp. 25–30.

Appl. Phys. Lett., vol. 56, No. 3, Jan. 15, 1990, pp. 236–238; R. B. Marcus et al.: "Formation of silicon tips with <1 mn radius".

Sov. Phys. Tech. Phys. vol. 20, No. 6, Jun. 1975, pp. 795–798; S. I. Kovbasa et al.: "Shaping of fine–tip emitters by electrochemical etching".

IEEE Transactions on Electron Devices, vol. 36, No. 11, Nov. 1989, New York, pp. 2703–2708; R. A. Lee et al.: "A Semiconductor Fabrication Technology Applied to Micrometer Valves".

Journal De Physique, vol. C9, No. 12, Dec. 1984, Paris, pp. 269–278; C. A. Spinot et al.: "Recent progress in low–voltage field–emission cathode development".

Nikkei Electronics, No. 512, Oct. 29, 1990 (Full Translation).

*Primary Examiner*—P. Austin Bradley
*Assistant Examiner*—Jeffrey T. Knapp
*Attorney, Agent, or Firm*—Staas & Halsey

[57] ABSTRACT

Microscale cold cathodes include a metallic emitter tip with a very sharp end. The microscale cold cathodes are manufactured by forming a cone of metal on a substrate, oxidizing the surface of the cone, and removing the oxidized film from the cone surface to produce an emitter tip.

4 Claims, 4 Drawing Sheets

METHOD OF PRODUCING METALLIC MICROSCALE COLD CATHODES

This application is a continuation of application Ser. No. 07/867,514, filed Apr. 13, 1992.

BACKGROUND OF THE INVENTION

1. Field of the Invention

The invention relates to a method of producing microscale cold cathodes, and more particularly, to an improved method of producing metallic microscale cold cathodes by which emitter cones for emitting electrons can be reproducibly and stably produced in given shapes.

2. Description of the Related Art

Microscale cold cathodes are essential components of emitting electrons for vacuum microelectronic devices such as extreme microscale microwave vacuum tubes and flat-panel display elements. The microscale cold cathodes are composed of, for example, an emitter tip having a conical shape formed on a substrate such as a semiconductor. The cone of the emitter tip is surrounded by a gate electrode, which is separated from the substrate by a gate insulating film, and a gate electrode aperture is formed in the gate electrode around the conical emitter tip. The principal parameters dominating the performance characteristics of the microscale cold cathodes are the radius of the aperture of the gate electrode, the height of the emitter chip, and the thickness of the gate insulating film, and the like. Also, the radius of curvature of the end of the emitter chip is a very important factor in the performance of a cold electrode.

Microscale cold cathodes having such a structure, known as Spindt-type cold cathodes, may be formed by a method using a leaning evaporation as described in C. A. Spindt, J. Appl. Phys., 39 (1968) p. 3504, or a method using a side etching as described in H. F. Gray and G. J. Campisi, Mat. Res. Soc. Symp. Proc., 76 (1987) p. 25. The former method is used when forming a cold cathode of metal, and the latter method is used when producing a cold cathode of silicon.

According to the method of Gray et al., a microscale cold cathode of silicon is produced as follows:

A first insulation film, e.g., a film of $SiO_2$, having a uniform thickness is formed on a silicon substrate by a known thermal oxidation process, and thereafter a photolithography process is used to form an insulation film mask pattern having, e.g., a circular configuration, by etching the film with hydrofluoric acid. The thus-processed substrate is then subjected to a chemical etching process, e.g., with a KOH solution to anisotropically etch the silicon and form a cone beneath the insulating mask pattern. In this case, the etching process is stopped before the insulation film mask pattern is separated from the top of the cone.

A second insulation film, e.g., a film of $Si0_2$, is then formed on the substrate from above, by an electron beam evaporation, in such a manner that a certain space is formed around the cone. Then, a gate electrode film, e.g., a film of Mo, is uniformly deposited on the thus-processed substrate from above by a known process, in such a manner that at least a portion of the side of the mask pattern of insulation film situated over the cone is exposed.

The mask pattern of the $SiO_2$ insulation film is then etched with hydrofluoric acid (HF) to communicate the space around the cone with the external space thereof. In this case, the etching process is stopped at a point such that the mask pattern remains on the top of the cone. Thereafter, only the silicon is isotropically etched, by a mixed solution of HF and $HNO_3$, to sharpen the end of the cone while separating the mask pattern from the cone, to thus form a microscale cold cathode having a silicon emitter tip on the silicon substrate. The configuration of the gate electrode is then adjusted by a pattern etching of the gate electrode film, as required.

In this method, however, it is difficult to reproducibly form emitter tips because of the difficulty of determining the point at which the etching should be stopped An alternative method has been proposed, in which the etching of the silicon cone is stopped when the mask pattern of the insulating film is separated from the cone, and an ion beam of, e.g., $Ar^+$ is irradiated to the plane top remaining on the end of the cone, to thereby remove the material around the center of the plane top of the cone and taper the cone end, and thus form an emitter tip having a stable and sharp end.

Although this method provides an excellent reproducibility, it has a defect of a poor electron emission due to damage caused by the irradiation of the ion beam.

Since silicon has a relatively high resistivity, sometimes silicon cathodes cannot be used in applications requiring a large amount of electrical current. Therefore, in such a case, it is necessary to use a metal having a high melting point and low resistivity for the emitter tip.

Cold cathodes of metal may be produced by the method described in the report by Spindt, as referred to above. According to this method, an insulation film and a gate film are sequentially deposited on a substrate, and an aperture is made through both films by an etching thereof. A material such as alumina is then obliquely evaporated, as a sacrificial layer, onto the surface of the gate film, while rotating the substrate, in such a manner that the evaporated material is not deposited at the bottom of the aperture. Thereafter, a metal material for the emitter is evaporated perpendicular to the substrate, whereby a conical emitter tip is formed inside the aperture and on the substrate due to a reduction of the size of the aperture in the gate film caused by the evaporation. Unnecessary metal is then removed by etching the sacrificial layer, to thereby complete the forming of a microscale cold electrode.

The end of the emitter tip thus formed has a radius of curvature at best of around 20 to 30 nanometers, and to obtain better electron emission properties, preferably the end of the metallic emitter tip has a smaller radius of curvature.

SUMMARY OF THE INVENTION

An object of the invention is to provide a method of reproducibly and stably producing metallic microscale cold cathodes having a reduced radius of curvature of the end thereof and able to provide better electron emission properties, for example, a radius of curvature on the order of 5 nanometers or smaller.

According to the present invention, there is provided a method of producing a metallic microscale cold cathode comprising a metallic emitter tip formed on a substrate, the emitter tip being located inside an aperture formed by a gate electrode of a metallic film provided on an insulating film surrounding the emitter tip, wherein the improvement comprises forming a metallic emitter tip by a process comprising the steps of: (i) forming a cone consisting of a metallic material for the emitter tip on a substrate, (ii) oxidizing the surface of the metal cone to thereby form an oxidized film, and (iii) forming an emitter tip having a reduced radius of curvature by removing the oxidized film from the surface of the cone of metal.

BRIEF DESCRIPTION OF THE DRAWINGS

The above and other objects and advantages of the present invention will be more fully understood from the following detailed description given with reference to the accompanying drawings, in which.

DESCRIPTION OF THE PREFERRED EMBODIMENTS

Figure 1A:
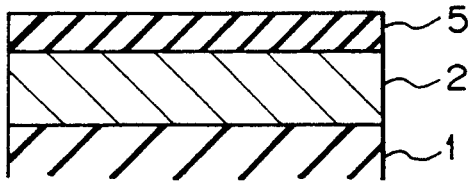
FIGS. 1A to 1G are schematic views of the steps of the process of an embodiment of the invention.

According to the present invention, a cone, consisting of a metal material to be formed into an emitter tip, is formed on a substrate. The metal cone may be formed by any known process, e.g., by masking a portion of the metal in which an emitter tip is to be produced, and etching the metal using a reactive ion etching process to thereby form a cone of the metal. The cone thus formed may have a plane top, and the mask used in the etching process may remain on the plane top of the cone. A diameter of the plane top of the cone sufficient for supporting the mask can be advantageously controlled by the etching conditions. Further, any metal having a high melting point is preferably used for the emitter tip material, such as tantalum, molybdenum, titanium or niobium.

The metal material for making the emitter tip may be a film provided on a substrate of another material, such as silicon or glass. Alternatively, a substrate may be made of a metal from which the emitter tip is to be formed, as exemplified above.

The surface of the metal cone thus formed is subsequently oxidized, to form an oxidized film thereover. In general, metal surfaces are not easily oxidized, unlike silicon which is readily oxidized by thermal oxidation, and a preferred oxidation process of a metal for an emitter tip depends on the metal material to be used. For an emitter tip made of tantalum, for example, an oxidized film may be advantageously formed by an anodizing process.

In the oxidation process of the metal surface, it is essential to precisely control the oxidized film thickness, to thereby ensure the obtaining of an emitter end having a radius of curvature as small as 5 nanometers or less. This control of the film thickness is easily accomplished when the film of metal is oxidized by anodizing same.

The oxidized metal film is then removed from the surface of the cone to thereby expose a metallic emitter tip having an end with a very small radius of curvature. Preferably, the oxidized film is removed in such a manner that no adverse affect is imposed on other elements such as a gate electrode and insulation film. In this step of removing the oxidized film, the mask used for making the metal cone, and remaining on the plane top thereof, is advantageously separated therefrom during the removing of the oxidized film.

A preferable and typical process for removing the oxidized metal film is an electric-protecting treatment whereby the unoxidized metal material for the emitter tip is used as a cathode, i.e., a cathodic protection technology. Using this treatment, an oxidized film of a metal such as tantalum and niobium can be preferentially removed to thereby form a reproducible emitter tip. The cathodic protection treatment is also very effective when removing the oxidized metal film, because the oxidized film thickness can be stably controlled if the film is formed by anodizing.

Gate electrodes for working the microscale cold cathode of the invention are preferably made by known methods of forming cold electrodes of silicon, i.e., a technology of lifting off the mask used for forming a metallic cone.

Therefore, the invention further provides a method of producing a metallic microscale cold cathode comprising a metallic emitter tip formed on a substrate, the emitter tip is located inside an aperture formed by a gate electrode of a metallic film provided on an insulating film surrounding the emitter tip, and the method comprises the steps of: (a) forming an insulation film (e.g., silicon dioxide film) on a metallic material to be formed into an emitter tip (e.g., by ion-beam-assisted deposition or sputtering), (b) patterning the insulation film, to thereby form a mask of the insulation film, (c) etching the metallic material, using this mask, to thereby form a cone of the metal beneath the mask, (d) oxidizing the surface of the remaining metallic material to thereby form an oxidized metal film (e.g., by anodizing), and thus form an emitter tip of the unoxidized metal material inside the oxidized film, (e) forming an insulating film and then a metallic film over the substrate, to make a gate electrode, (f) removing the oxidized film under the mask (e.g., by using cathodic protection), which has been uncovered by the insulating film and metallic film in the step (e), to thus lift off the mask and bare the emitter tip while forming an aperture, by which the emitter tip and the gate electrode are separated from each other, and (g) patterning the metallic film on the insulating film formed in the step (e) to thereby form a gate electrode.

Referring to FIGS. 1A to 1G, an embodiment of the invention will be illustrated by way of example.

As shown in FIG. 1A, a silicon wafer 1 having a thickness of 1.1 millimeters was used as a substrate, tantalum film 2 having a thickness of 2 micrometers was formed on the substrate 1 by a sputter process, and a silicon dioxide ($SiO_2$) film 5 for masking and having a thickness of 1 micrometer was then formed on the metal film 2 by a sputter process.

Figure 1B:
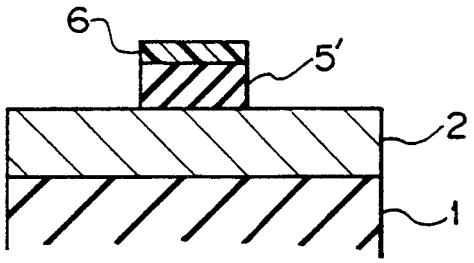

A resist mask 6 having a diameter of 2 micrometers was then formed on the $SiO_2$ film 5, i.e., the insulation film, and a mask pattern 5' of the insulating film consisting of the $SiO_2$ film having a diameter of 2 micrometers was formed by a reactive ion etching using $CF_4$ and hydrogen gases, as shown in FIG. 1B, and thus the formed mask pattern 5' had a diameter of two times the height thereof.

Figure 1C:
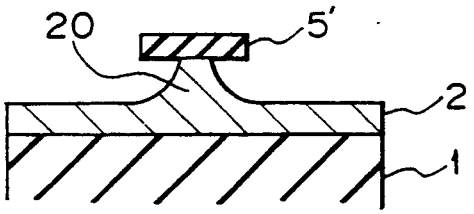

The tantalum film 2 was then etched by a reactive ion etching using $SF_6$ gas. The portion of the tantalum film 2 under the mask pattern 5' was underetched, whereby a cone 20 was formed under the mask pattern 5' as indicated in FIG. 1C. In this case, the etching was discontinued when the diameter of the top of the cone reduced by the etching became 0.3 micrometers and the mask pattern 5' was still attached to the cone 20.

Figure 1D:
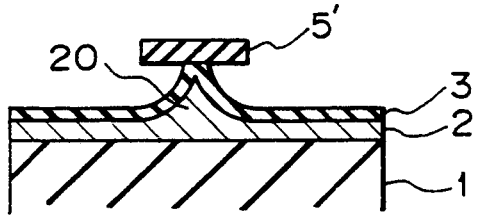

The surface of the etched tantalum film 2, including the cone 20, was then anodized in an aqueous solution based on phosphoric acid, to form an oxidized film 3 having a thickness of 150 nanometers, as shown in FIG. 1D.

Figure 1E:
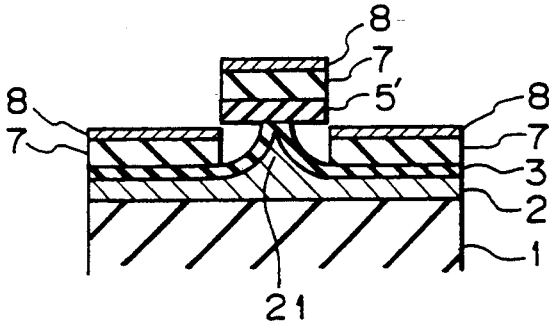

A sputtered silicon monoxide (SiO) film 7 having a thickness of 1 micrometer as a gate insulating film and an evaporated chromium (Cr) film 8 having a thickness of 200 nanometers as a gate metal film were successively formed from above, as shown in FIG. 1E, and at this time, a space was created between the cone 20 and the gate insulating and metal films 7 and 8 formed on the tantalum film 2, and surrounding the cone 20 as indicated in the drawing, and at least a portion of the side of the mask pattern 5' was exposed (in FIG. 1E, the side of the mask pattern 5' is fully exposed so that the space around the cone 20 is communicated with the outside).

Figure 1F:
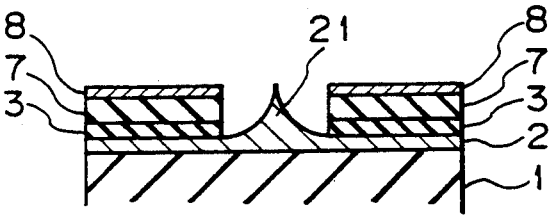

The oxidized film 3 on the surface of the exposed cone 20 was then removed by electric-protectively processing the oxidized film in a hot aqueous solution of NaOH, using the tantalum film 2 as the cathode, to dissolve only the oxidized film 3 in the solution and thereby form an emitter tip 21, as indicated in FIG. 1F. The mask pattern 5' with the surplus films 7 and 8 formed thereon was spontaneously lifted off by this processing. If the space created beneath the mask pattern 5' and around the cone 20 is not communicated with the outside before removing the oxidized film 3 because the side of the mask pattern 5' is only partly exposed, the space could be exposed by preferentially etching the $SiO_2$ film mask pattern with hydrofluoric acid.

Figure 1G:
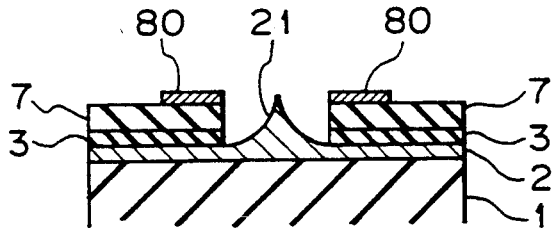

The gate metal film 8 remaining on the gate insulating film 7 was then pattern-etched into a specified configuration through a known photolithography, to thereby form a gate electrode 80, as shown in FIG. 1G.

In this embodiment of the invention, microscale cold cathodes having a bottom diameter of about 2 micrometers, a height of about 1 micrometer, and a radius of curvature of the end of less than 20 nanometers were reproducibly and stably obtained, and microscale cold cathodes of niobium could be obtained in a similar manner.

Figure 2:
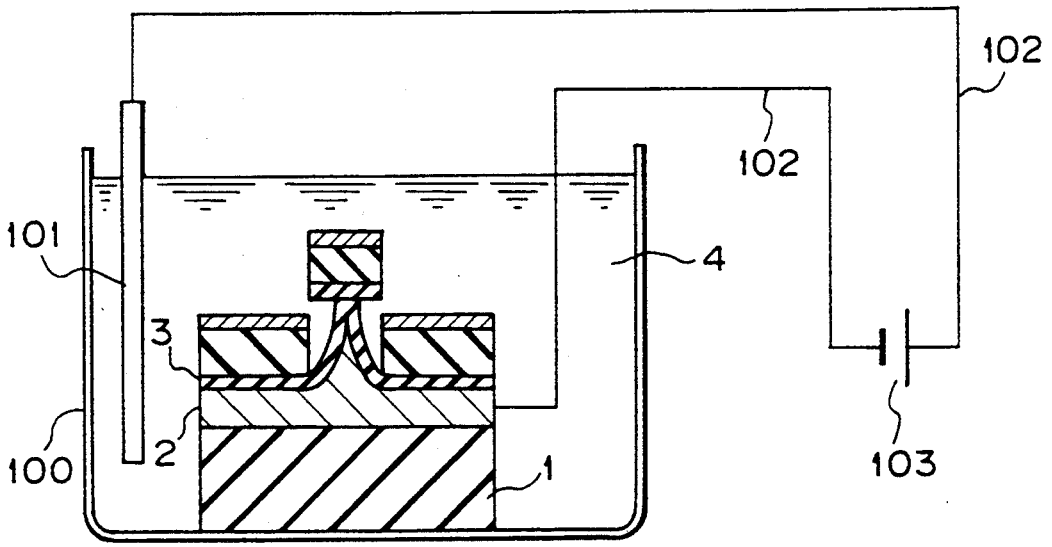
FIG. 2 illustrates the forming of an emitter tip using a cathodic protection.

FIG. 2 illustrates an electric protective formation of an emitter tip in the invention. In the drawing, a solution for dissolving an oxidized film 3 is indicated by reference numeral 4. For example, a hot aqueous solution of NaOH is preferably used for a film of $Ta_2O_5$. Reference numeral 100 is a container made of, e.g., glass, 101 is an anode of, e.g., platinum plate, 102 shows lead wires, and 103 is a current source. In the drawing, the reference numerals referred to in the preceding description denote the same elements.

In the embodiment described above, to process the anodized $Ta_2O_5$ film 3 in a 30% NaOH solution in water at 90° C., the tantalum film 2 was used as the cathode and an electric voltage of 1.5 volts was applied for about 2 minutes, and consequently, emitter tips 21 (FIG. 1F) with a very sharp end were reproducibly formed.

Figure 3:
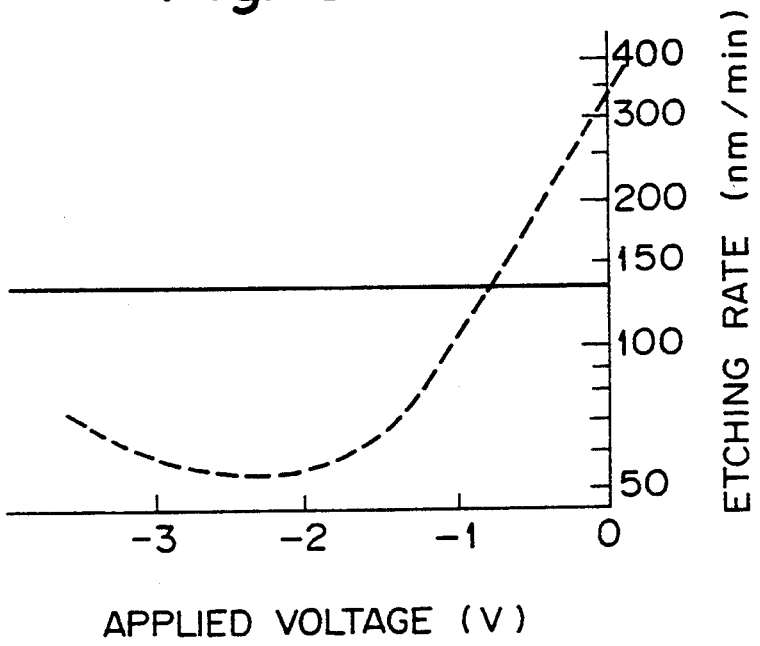
FIG. 3 shows a comparison between etching rates of an anodized $Ta_2O_5$ film and a sputtered Ta film; and, FIG. 4 shows the interrelationship between emission current and gate voltage observed in cold cathodes according to the invention, compared with that in cold cathodes made by a prior art method.

FIG. 3 is a graph comparing two etching rates, in which the etching rate is given on the ordinate axis, and the applied voltage is shown on the abscissa axis. In this drawing, the solid line represents the etching rate of an anodized $Ta_2O_5$ film, i.e., oxidized film 3, and the broken line represents that of a sputtered Ta film, i.e., metal film 2.

By way of an example, the anodized $Ta_2O_5$ film has a constant etching rate of 130 nanometers per minute, regardless of the application or no application of a voltage, or an indeterminate application of a voltage, whereas the sputtered Ta film displays a notable dependence on the applied voltage, and the etching rate thereof at −1 to −3 volts is 50 to 70 nanometers per minute, indicating much lower values, compared with the etching rate of the anodized $Ta_2O_5$ film, of one half to one third thereof.

Namely, it can be seen that, since the sputtered Ta film of metal has a minus potential, the dissolution thereof is electrochemically limited, and the electric protecting effect is remarkable.

Figure 4:
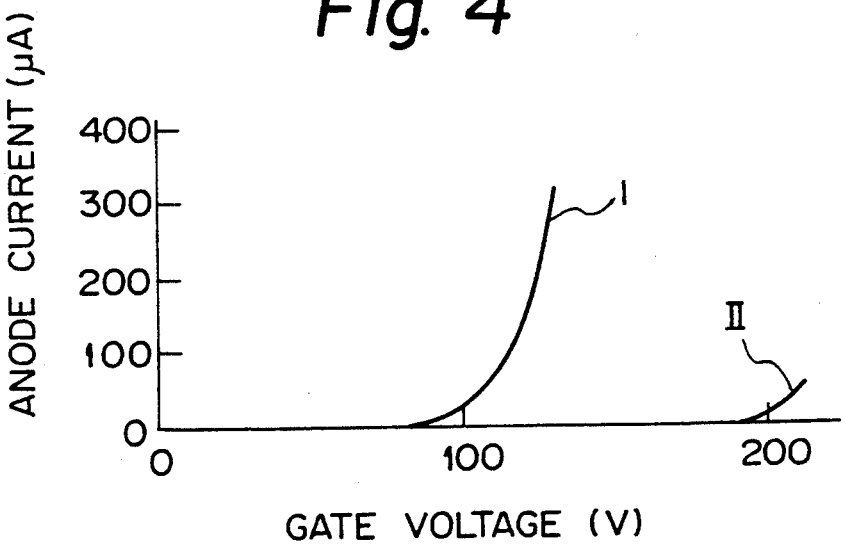

FIG. 4 illustrates the interrelationship between the emission current, i.e., anode current, and gate voltage. In the drawing, data obtained from samples according to the invention is indicated by the curve I, and for a comparison, data obtained from samples produced by a prior method, i.e., a method not using the formation of an anodized film, and an electrically protecting process for dissolving thereof, is indicated by the curve II. All of the data was determined by placing an anode above microscale cold cathodes, applying a voltage of 500 volts between the anode and the cold cathodes, and varying an applied gate voltage. In all cases, the data shown in the drawing is an average of the samples in which 100 emitters are arranged in an array thereof.

As can be seen from the drawing, in the microscale cold cathodes according to the method of the invention, an emission current is observed under a gate voltage of no less than 100 volts lower than those according to the prior method, and a very sharp emitter tip is reproducibly formed.

These embodiments of the invention described by way of example will enable a person with intent to carry out the present invention to use any preferred material and process without departing from the spirit and scope of the invention.

We claim:

1. A method of producing a metallic microscale cold cathode having a metallic emitter tip formed on a substrate, the emitter tip being located inside an aperture formed in a gate electrode of a metallic film provided on an insulating film surrounding the emitter tip, the method comprising steps of:

(a) forming an insulation film on a metallic material to be formed into an emitter tip;

(b) patterning the insulation film to form a mask of the insulation film;

(c) etching the metallic material using the mask to form a cone of the metal beneath the mask;

(d) oxidizing the surface of the remaining metallic material to form an oxidized metal film, so that an emitter tip of the unoxidized metal material is formed inside the oxidized metal film;

(e) successively forming over the substrate an insulating film and a metallic film to make a gate electrode;

(f) removing the oxidized film under the mask, which has been uncovered by the insulating film and metallic film in said step (e), to thus lift off the mask and expose the emitter tip while forming an aperture separating the emitter tip and the gate electrode and performing an electrically protecting treatment using the unoxidized metal material for the emitter tip as a cathode; and (g) patterning the metallic film on the insulating film formed in said step (e) to thereby form the gate electrode.

2. The method of claim 1, wherein said step (d) includes oxidizing the surface of the cone by anodizing.

3. The method of claim 1, wherein the cone is formed from a film of a metallic material formed on another material as the substrate, or the cone is formed from a metallic substrate.

4. The method of claim 1, wherein the cone is made of tantalum, molybdenum, titanium or niobium.

* * * * *